US005261374A

United States Patent [19]

Gronenberg et al.

[11] Patent Number: 5,261,374

[45] Date of Patent: Nov. 16, 1993

[54] METHOD AND APPARATUS FOR CONTROLLING A SOLENOID-VALVE-CONTROLLED FUEL-METERING SYSTEM

[75] Inventors: Roland Gronenberg, Stuttgart; Werner Fischer, Heimsheim; Peter Schmitz, Ludwigsburg; Dietbert Schoenfelder; Joachim Tauscher, both of Stuttgart, all of Fed. Rep. of Germany

[73] Assignee: Robert Bosch GmbH, Stuttgart, Fed. Rep. of Germany

[21] Appl. No.: 884,020

[22] Filed: May 18, 1992

[30] Foreign Application Priority Data

Jun. 21, 1991 [DE] Fed. Rep. of Germany ..... 4120464
Feb. 12, 1992 [DE] Fed. Rep. of Germany ..... 4204091

[51] Int. Cl.[5] ..... F02M 37/04; F02M 7/00; F02D 41/40

[52] U.S. Cl. ..... 123/436; 123/501; 123/506

[58] Field of Search ..... 123/478, 480, 492, 493, 123/494, 500, 501, 503, 506, 419, 436

[56] References Cited

U.S. PATENT DOCUMENTS

| | | | |
|---|---|---|---|
| 4,265,200 | 5/1981 | Wessel et al. | 123/501 |
| 4,357,662 | 11/1982 | Schira et al. | 123/419 |
| 4,395,987 | 8/1983 | Kobayashi et al. | 123/506 |
| 4,397,284 | 8/1983 | Kaibara et al. | 123/502 |
| 4,397,285 | 8/1983 | O'Neil | 123/502 |
| 4,502,438 | 3/1985 | Yasuhara | 123/494 |
| 4,574,756 | 3/1986 | Ito et al. | 123/500 |
| 4,653,454 | 3/1987 | Konishi et al. | 123/506 |
| 4,757,795 | 7/1988 | Kelly | 123/501 |
| 4,760,830 | 8/1988 | Bullis et al. | 123/501 |
| 4,766,863 | 8/1988 | Fujimori | 123/419 |
| 4,788,960 | 12/1988 | Oshizawa | 123/506 |
| 4,825,373 | 4/1989 | Nakamura et al. | 123/501 |
| 4,831,988 | 5/1989 | Hoefken et al. | 123/501 |
| 4,838,232 | 6/1989 | Wich | 123/506 |
| 4,840,155 | 6/1989 | Karle | 123/506 |
| 4,856,482 | 8/1989 | Linder et al. | 123/506 |
| 4,862,853 | 9/1989 | Tsukamoto et al. | 123/506 |
| 4,870,939 | 10/1989 | Ishikawa et al. | 123/506 |
| 4,957,086 | 9/1990 | Sasaki et al. | 123/478 |
| 4,982,330 | 1/1991 | Karle et al. | 123/480 |
| 5,086,741 | 2/1992 | Nakamura et al. | 123/436 |
| 5,094,216 | 3/1992 | Miyaki et al. | 123/506 |
| 5,103,792 | 4/1992 | Winkler et al. | 123/506 |
| 5,105,788 | 4/1992 | Engel | 123/436 |
| 5,113,830 | 5/1992 | Haines | 123/436 |
| 5,115,783 | 5/1992 | Nakamura et al. | 123/506 |
| 5,117,793 | 6/1992 | Taue et al. | 123/436 |
| 5,195,492 | 3/1993 | Gronenberg et al. | 123/506 |
| 5,197,439 | 3/1993 | Gronenberg et al. | 123/506 |
| 5,205,262 | 4/1993 | Anton et al. | 123/506 |

FOREIGN PATENT DOCUMENTS

| | | | |
|---|---|---|---|
| 4004107 | 8/1991 | Fed. Rep. of Germany . | |
| 4004110 | 8/1991 | Fed. Rep. of Germany . | |
| 63-223350 | 9/1988 | Japan | 123/480 |

*Primary Examiner*—E. Rollins Cross
*Assistant Examiner*—Thomas Moulis
*Attorney, Agent, or Firm*—Kenyon & Kenyon

[57] ABSTRACT

A method and apparatus for controlling a solenoid-valve-controlled fuel-metering system, especially for a diesel internal combustion engine, provide an electronic control device, which calculates a starting time and/or a stopping time for a solenoid valve based upon at least one of an injection start variable and a feed duration variable. An angle variable is calculated based upon a time variable, taking into consideration at least one of an instantaneous rotational speed and a correction angle.

22 Claims, 4 Drawing Sheets

METHOD AND APPARATUS FOR CONTROLLING A SOLENOID-VALVE-CONTROLLED FUEL-METERING SYSTEM

FIELD OF THE INVENTION

The present invention relates to a method and apparatus for controlling a solenoid-valve-controlled fuel-metering system, and in particular to a method and apparatus for determining an angle variable from a time variable.

BACKGROUND OF THE INVENTION

A method and apparatus for controlling a diesel fuel internal combustion engine with a solenoid-valve-controlled fuel-metering system are known from German Patent Application No. 40 04 110, which is not prior art with respect to the present application. The fuel-metering system comprises a fuel pump with a pump piston driven by the cam shaft. The piston pressurizes the fuel and feeds it into the individual cylinders. The feed start and the feed end can be determined by way of at least one solenoid valve. For this purpose, a control device calculates the control times for the solenoid valve, as a function of markings located on a shaft.

In such systems, however, the control device transmits control signals in the form of time variables. The precise start of injection must take place at a certain position of the crank shaft (angle variable). The end of injection occurs when the cam shaft has rotated a certain angle after the start of injection. For this reason, time variables have to be converted into angle variables, and angle variables into time variables, when using an rpm value. The accuracy of this conversion is largely dependent on the rpm value that is used.

Furthermore, German Patent Application No. 40 04 107, which is also not prior art with respect to the present application, describes a method and apparatus for controlling a solenoid-valve-controlled fuel pump. An electronic control apparatus calculates the starting and stopping times for one or more solenoid valves based upon the desired start of injection and the desired injection period. In this calculation, the switching times of the solenoid valves are taken into consideration.

In the calculation of the stopping time, the actual start of feed is included. In this apparatus, the end of feed is determined based upon the desired feed duration and the actual start of feed. In this apparatus, time variables are also processed. Since the injected fuel amount is significantly dependent upon the angle position of the cam shaft at the actual start of injection, i.e., at the actual feed start, when other conditions are constant, this method of operation results in a significant error in the quantity of fuel injected into the engine.

It is an object of the present invention to improve the accuracy of fuel metering in a method and apparatus for controlling of a solenoid-valve-controlled fuel-metering system.

SUMMARY OF THE INVENTION

The present invention provides a method and apparatus for controlling a solenoid-valve-controlled fuel-metering system for an internal combustion engine. A starting time and/or a stopping time for actuating the solenoid valve is determined based on a feed start and/or a feed duration variable. An angle variable is then determined based upon a time variable, taking the instantaneous rotational speed and/or a correction angle into consideration.

Conversion of the actual start of injection from a time variable into an angle variable based upon the actual start of injection results in significantly more accurate fuel metering.

DETAILED DESCRIPTION OF THE INVENTION

The present invention is described below with respect to an auto-ignition internal combustion engine. However, the present invention can also be used for control of spark-ignition internal combustion engines, in which the problem of having to convert time variables into angle variables also occurs.

Figure 1:
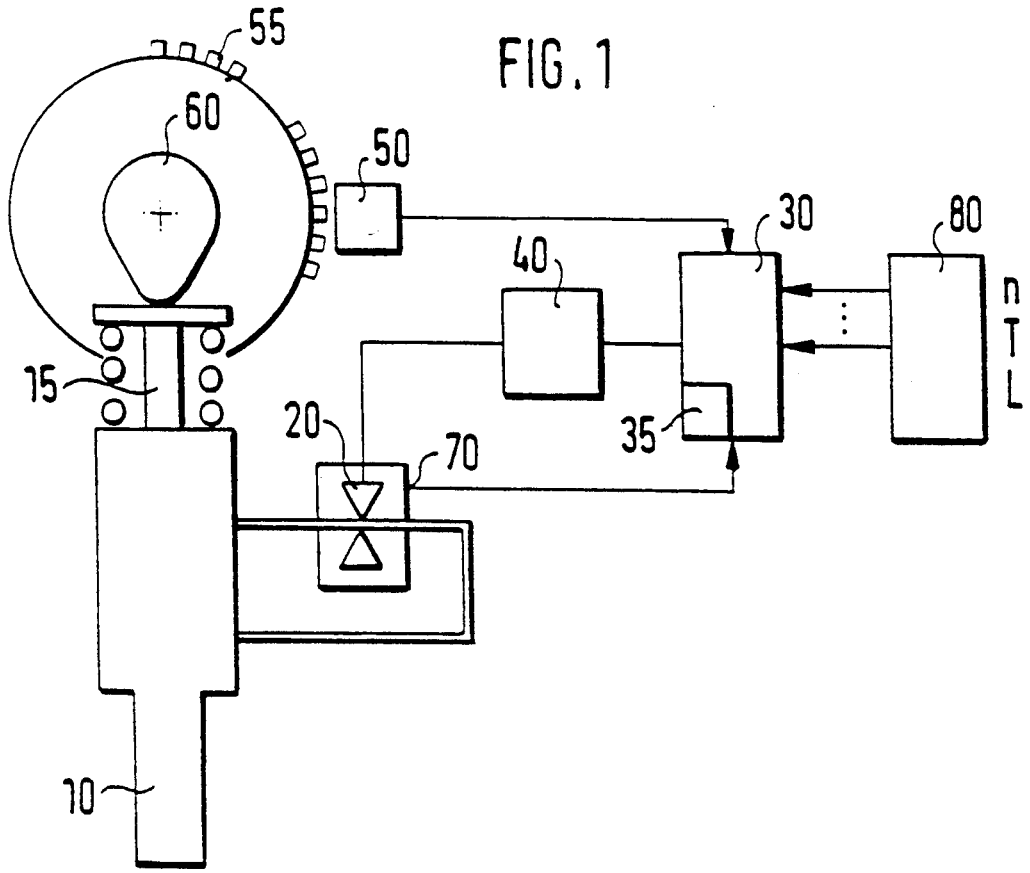
FIG. 1 shows a block diagram of the control apparatus according to the present invention.

FIG. 1 shows the control apparatus for solenoid-valve-controlled fuel pumps for diesel engines. Fuel is passed to a single cylinder of an internal combustion engine (not shown) via a fuel pump 10, which contains a pump piston 15. A fuel pump 10 can be assigned to each cylinder (pump-nozzle system). Alternatively, a fuel pump (distributor pump) can pass the fuel into the individual cylinders on an alternate basis.

The fuel pump 10 is connected to an electromagnetic valve 20. The valve 20 is supplied with switching pulses, via a power stage 40, by an electronic control unit 30, which comprises a fixed memory 35. A transducer 70, which is located at the electromagnetic valve 20 or at an injection nozzle (not shown), supplies signals to the electronic control unit 30.

Angle markers are located on an increment wheel 55 affixed to the cam shaft 60. Each two markers define an increment. The increment wheel has at least one increment gap. An increment gap can be implemented, for example, by means of a missing tooth or a corresponding measure. A measurement device 50 detects the pulses triggered by the angle markers, and thus also the rotational movement of the increment wheel 55, and delivers corresponding signals in the form of pulses to the electronic control unit 30.

From additional sensors 80, information about additional variables, such as average speed of rotation n, temperature T, or load L (gas pedal position), is input to the electronic control unit 30. The average speed of rotation n is determined over a large range of angles. Preferably, a transducer is provided, which provides only a small number of pulses during a rotation of the crank shaft or the cam shaft. Preferably, one to four pulses per rotation are detected and evaluated for a determination of the average speed of rotation n. Preferably, the average speed of rotation is determined over an engine cycle or a combustion process.

The control unit 30 determines the desired feed start FBS and the desired feed duration FDS of the fuel pump 10, as a function of the variables supplied by the sensors 80 and the rotational movement of the pump drive shaft detected by the measurement device 50. Based upon these reference values for the feed start FBS and the desired feed duration FDS, the control unit then calculates the control times A and E for the power stage 40. Among others, the variables for speed of rotation, air temperature, lambda (λ) value, fuel temperature, as well as other temperature values, the position of the gas pedal, and/or the desired driving speed can be included as characteristic operating variables. Instead of the rotational movement of the pump drive shaft, the rotational movement of the cam shaft and/or the crank shaft can be evaluated.

The cam shaft of the internal combustion engine, or a shaft coupled with it, functions as the pump drive shaft. The pump drive shaft drives the pump piston 15 in such a way that the fuel in the fuel pump 10 is pressurized. The electromagnetic valve 20 controls the pressure build-up. The electromagnetic valve is preferably positioned in such a way that when the valve is open, no significant pressure build-up occurs. Only when the electromagnetic valve 20 is closed does pressure build up in the fuel pump.

With corresponding pressure in the fuel pump, a valve (not shown) opens, and the fuel reaches the combustion space of the internal combustion engine via an injection nozzle (not shown). The transducer 70 serves to check the time at which the solenoid valve opens and closes. The transducer 70 can also be affixed to the injection nozzle, in which case it generates a signal which represents the actual start or end of the injection of fuel into the combustion chambers. Instead of the output signal of the transducer 70, a signal which indicates the position in which the solenoid valve is located can be used. Such a signal is obtained by evaluating of the current flowing through the solenoid valve or the voltage applied to the solenoid valve.

Figure 2:
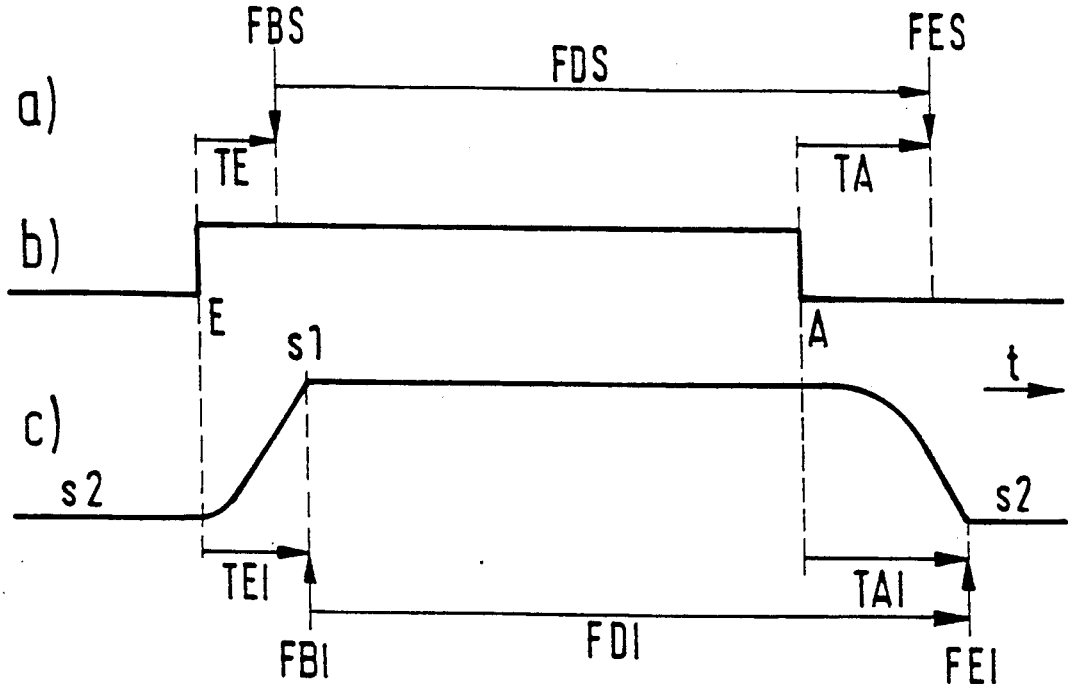
FIG. 2 shows various variables which are used in fuel metering.

FIG. 2 shows the time sequence of the different signals. In FIG. 2*a*, the desired feed start FBS and the desired feed end FES are marked. The desired feed duration FDS is the distance between the feed start and the feed end.

FIG. 2*b* shows the control signal for the electromagnetic valve. From the starting time E to the stopping time A, current is supplied to the electromagnetic valve. It is assumed that the switch-on time TE elapses between activation and closing of the electromagnetic valve. The starting time E, therefore, lies at a time TE before the desired feed start FBS. Similarly, it takes a certain amount of time after the stopping time A for the electromagnetic valve to open. Therefore, the stopping time A lies before the desired feed end FES by the shut-off time TA.

FIG. 2*c* shows the position of the valve needle of the electromagnetic valve. The valve needle is in the position S1 during the actual switch-on time TEI after the starting time E. From this position S1, pressure build-up in the fuel pump 10 begins. The actual switch-on time TEI generally does not correspond to the switch-on time TE. Therefore, the times of the actual feed start FBI and the desired feed start FBS also do not correspond. The same holds true for the feed end. The stopping time A lies before the actual feed end FEI by the actual shut-off time TAI. In a normal situation, the desired and actual feed end also will not take place at the same time.

The variations in the actual switching times TAI, TEI depend upon various parameters. These are production tolerances, hydraulic effects, temperature effects, changes in the solenoid valve or in the power stage, for example. Furthermore, the variations can be different in different operating states.

The actual fuel amount injected depends upon the feed duration FDS and the actual feed start FBI. In order to obtain the most accurate fuel metering possible, the actual feed start has to be known. Based upon the actual feed start, the stopping time for ending the injection is then calculated. Preferably, the feed duration is determined from performance characteristics, as a function of different operating conditions. The feed duration is preferably stored as an angle variable (feed angle) as a function of at least the average speed of rotation n and the load. The actual feed start FBI also has to be taken into consideration as an angle value. From the addition of the feed duration angle FDS and the actual feed start angle, the angle variable for the feed end is obtained. Again, this angle must be converted into a time signal for the stopping pulse A.

The normal sensors which indicate the actual feed start provide a signal at the time of the feed start. The information about the actual feed start FBI is therefore present as a time variable. But for exact metering, the position of the pump drive shaft at the time of the feed start must be known. In order to obtain the feed start with reference to the angle position of the cam shaft, conversion of the time variable into an angle variable has to take place. This angle variable must be available as early as possible, since the calculation of the stopping time, which establishes the feed end FE, can take place only if the actual feed start is present as an angle variable.

Therefore, the task of converting the time variable ZS into an angle variable WS is presented, where the angle variable WS is supposed to be known with high accuracy as early as possible. A method and apparatus for performing such a task will be explained below in greater detail.

Figure 3:
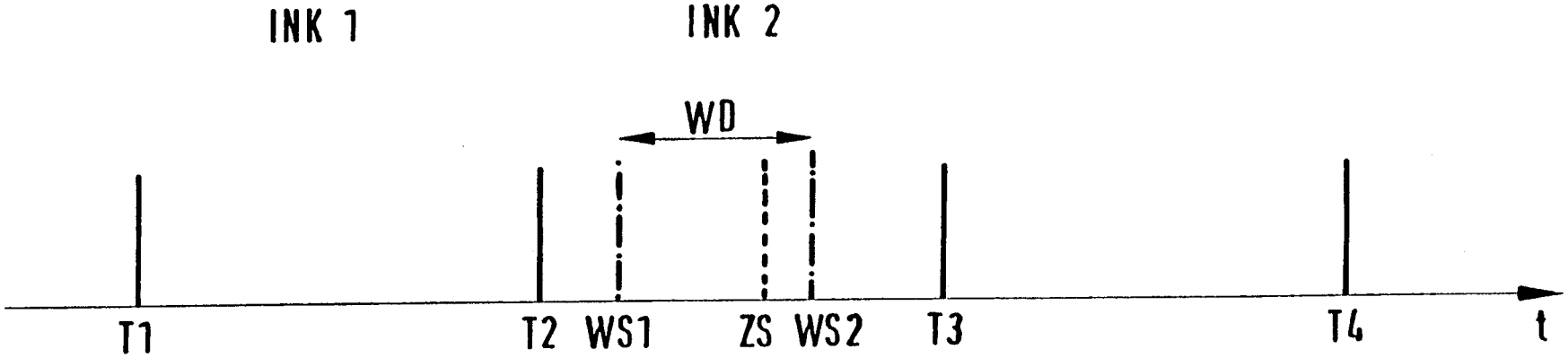
FIG. 3 shows the variables which are used in the calculation of the starting times.

FIG. 3 plots various signals over time to illustrate the present invention. For example, increment pulses occur at times T1, T2, T3, and T4. These pulses are generated by the sensor 50, which scans the increment wheel 55 located on the cam shaft. Two pulses define an increment. Thus, the pulse at time T1 and the pulse at time T2 define the increment INK1. The pulses T2 and T3 define the increment INK2.

At time ZS, a signal which indicates the actual start of injection FBI occurs. The increments INK1 and INK2 are selected in such a way that the time variable ZS lies between the times T2 and T3, i.e., in the second increment INK2. This time variable is converted into an angle variable WS. In the simplest case, this angle variable WS is calculated according to the expression:

$$WS = 6 * N * ZS \quad (1)$$

where N represents the instantaneous rotational speed in the second increment INK2, during which the time variable ZS occurs. The time interval between the start of the second increment INK2 and the occurrence of the injection start signal FBI serves as the time variable ZS. WS designates the corresponding angle variable, which is predetermined with reference to the start of the second increment INK2. A precise calculation is possible only when the instantaneous rotational speed N2 in the second increment INK2 is known. The result of this calculation, therefore, is not available until time T3, at the earliest.

Based upon the instantaneous rotational speed N1 in the first increment INK1, a first angle variable WSI is extrapolated. Based upon the instantaneous speed of rotation in the second increment INK2, a second angle variable WS2 is interpolated, when this RPM value is known. The distance between these two angle variables defines a difference angle WD.

In order to have an exact angle variable available as early as possible, the method of operation is as follows: Based upon the rotational speed in the increment INK1, the first angle variable is extrapolated. A correction angle WK is then added to this extrapolated angle variable. If the instantaneous speed of rotation N2 in the increment INK2 is known, the correction angle is calculated for the next metering. The correction angle for the next metering represents the sum of the current correction angle and the difference angle between the interpolated and the extrapolated angle variables.

Figure 4:
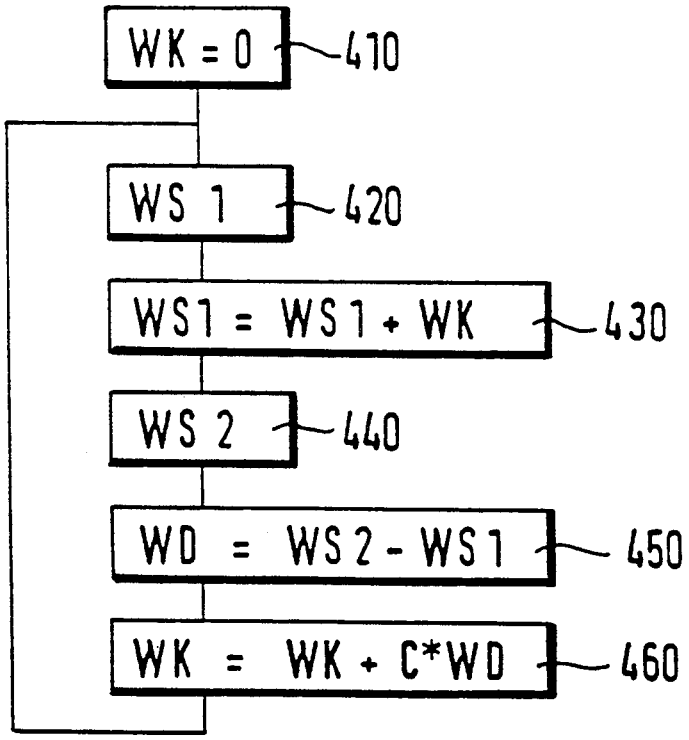
FIG. 4 shows a flow diagram to clarify the conversion of a time variable into an angle variable.

This method of operation will now be explained in greater detail with reference to the flow diagram of FIG. 4. In the initialization step 410, the correction angle WK is set to zero. Subsequently, in step 420, the calculation of the first angle variable WS1 takes place, based upon the instantaneous rotational speed N1 in the first increment INK1.

In step 430, the correction angle WK is added to this first angle variable WS1. After the instantaneous rotational speed N2 in the second increment INK2 is detected, the second angle variable WS2 is determined based upon this instantaneous rotational speed N2. This calculation can take place at time T3, at the earliest. In general, the calculation yields a more precise value because the instantaneous rotational speed in the vicinity of the time variable is included in the calculation. However, this value is only available one increment later.

The difference angle WD between these two angle variables WS1 and WS2 yields the deviation between the extrapolated first angle variable WS1 and the interpolated second angle variable WS2. In step 460, the correction angle WK is recalculated by adding the old correction angle and the difference angle WD. Preferably, the difference angle WD is multiplied by a factor C, which has a value between zero and one. In the next injection, the calculation of the angle variable starts once again with step 420.

With this method of operation, the angle variable is very accurate and is available very early with respect to the actual feed start.

The method according to the present invention is not limited only to the calculation of the actual feed start. It can be used in every instance when a time variable has to be converted to an angle variable, where the angle variable must be known as precisely and early as possible. Thus, the same method of operation can be used for calculation of the actual feed end, the actual injection start or the actual injection end.

Figure 5:
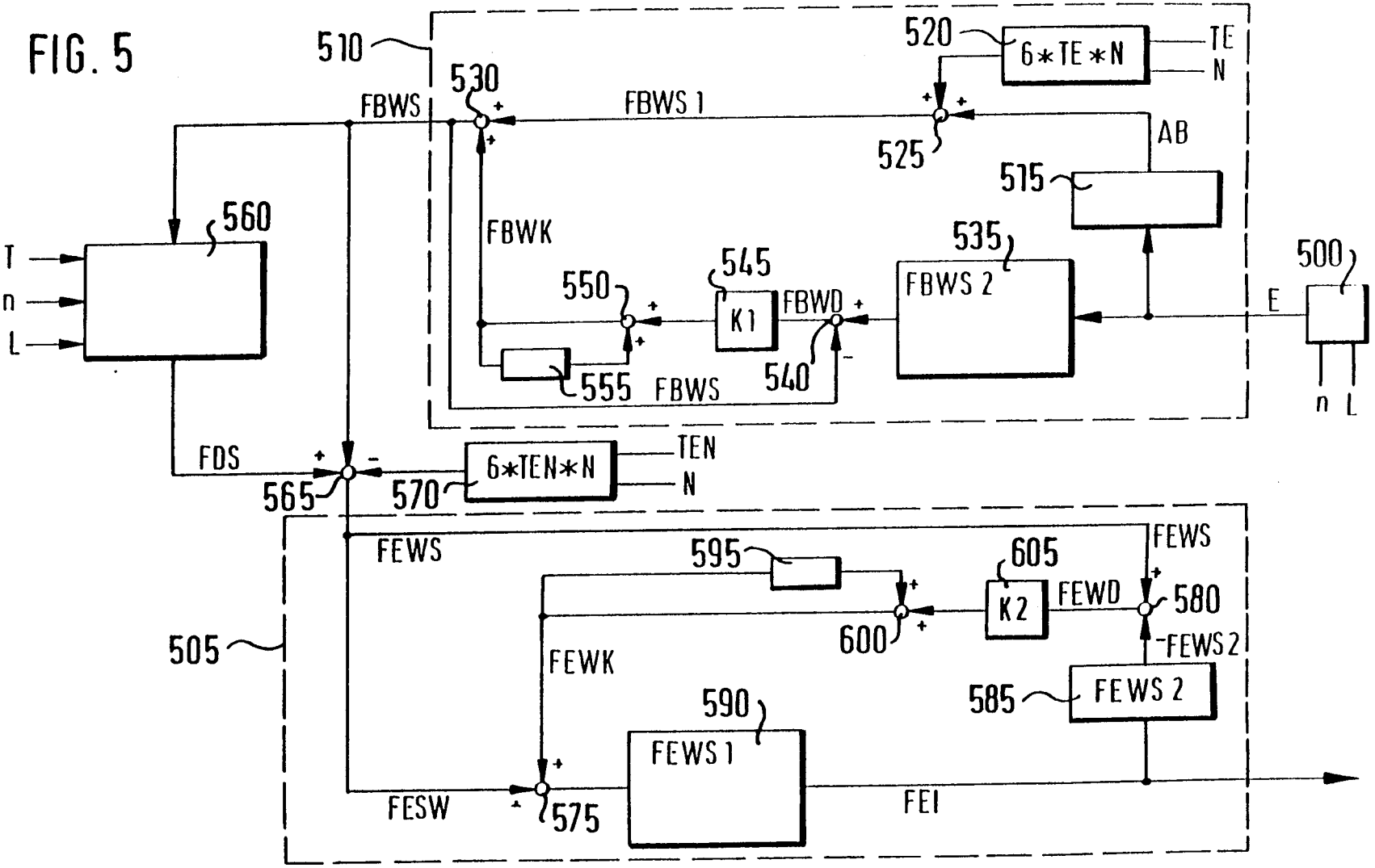
FIG. 5 shows the elements used for the calculation of the control variables for the start of feed and the feed duration.

A particularly advantageous application of the method of operation according to the present invention will now be explained referring to FIG. 5. FIG. 5 shows parts of the control unit 30, which serve to control the start of feed and the feed duration, particularly for a diesel internal combustion engine.

As essential components, the control unit 30 contains a block 500, which sets the starting time E for the solenoid valve to establish the feed start as a function of various operating characteristics. This signal reaches an observer 510 for the feed start. The observer calculates an angle variable FBWS, which indicates the actual feed start. This variable indicates the angle position of the pump drive shaft at the time of the feed start. Based upon this variable and further operating characteristics, performance characteristics block 560 outputs an angle variable for the desired feed duration FDS. Based upon this angle variable for the feed duration FDS and the angle variable FBWS for the feed start, an angle variable FEWS, which indicates the desired feed end, is determined. This variable reaches a feed end regulator 505, which regulates the feed end to the predetermined feed end FEWS.

The time signal E referring to the starting time for the solenoid valve is fed to an extrapolation 515 and a first interpolation 535. The output variable AB of the extrapolation 515 is fed to the addition point 525. At the second input of this addition point 525, the output variable of a switching angle calculation 520 is present.

At the output of the addition point 525, a first angle signal FBWSI referring to the feed start is present. This signal is fed to a first input of an addition point 530. At the second input of the addition point 530, the correction angle FBWK referring to the feed start is present. At the output of the addition point 530, and therefore also at the output of the observer 510, the angle variable FBWS referring to the feed start is present. This variable is passed to the second input of the addition point 540 with a negative sign.

At the first input of this addition point 540, the output variable of the first interpolation 535 is present. At the output of the addition point, a difference angle FBWD referring to the feed start, therefore, is present. This variable is multiplied by a factor K1 in a correction block 545, and fed to the addition point 550. At the second input of this addition point, the corresponding variable of the previous metering, which was placed in interim memory in block 555, is present. At the output of the addition point 550, the correction angle FBWK referring to the feed start is, therefore, available.

The output variable FDS of the performance characteristics 560 and the angle variable FBWS referring to the feed start are passed to an addition point 565 with a positive sign. In addition, the output variable of a second switching angle calculation 560 is fed to the addition point 565 with a negative sign.

At the output of the addition point 565, an angle variable FEWS referring to the desired feed end, is therefore present. This variable serves as the input variable for the feed end regulator 505. In the feed end regulator 505, the input variable is fed to an addition point 575, as well as to an addition point 580. At the second input of the addition point 575, a correction angle FEWK referring to the feed end is present.

The output variable of the addition point 575 is fed to block 590, which calculates the exact starting time A for the solenoid valve determining the feed end by means of extrapolation. Furthermore, in block 590, a variable which indicates the actual feed end FEI is acquired as a time variable. The second interpolation 585 converts this time variable into an angle variable FEWS2, which indicates the feed end, by means of interpolation. This angle variable FEWS2, which indicates the actual feed end as an angle variable, is passed to the addition point 580 with a negative sign.

The output variable of the addition point 580, i.e., the difference between the angle variable FEWS2 and the reference value FEWS for the feed end, is fed to the correction stage 605, which multiplies the output variable of the addition point 580 by a constant K2. The output variable of the correction stage 605 is fed to the addition point 600, where it is linked by addition with the value of the previous proportioning stored in memory in block 595. The total of these two variables then forms the correction angle FEWK for the feed end, which is fed to the addition point 575 with a positive sign.

This apparatus functions as follows: Based upon the starting signal E, which is present as a time variable, the extrapolation 515 calculates a first angle variable AB, which indicates the start of control. Subsequently, the angle variable AB is corrected by the switching angle. The switching angle calculation 520 calculates an angle variable which corresponds to the switching time based upon the known or calculated switching time TE. The switching angle is the angle which elapses between starting and feed start.

A correction of the angle variable FBWS1 with the correction angle FBWK takes place in the summing point 530. This correction angle indicates the deviation between the interpolated angle value FBWS2 and the angle value FBWS2. The angle variable FBWS obtained in this way reproduces the angle position at the time of feed start in a very precise manner. This correction angle is preferably determined during the previous metering.

For a calculation of the correction angle, the method of operation is as follows: After starting has taken place, the first interpolation 535 calculates the angle variable FBWS2 by interpolation. The time FBI for the actual feed start acquired by the transducer 70 is used.

The addition point 540 forms the difference FBWD between the interpolated and extrapolated angle variables.

In block 545, this difference is weighted with a factor K1. The correction value of the previous metering is then added to the value obtained in this manner. As a result, the new correction value FBWK for the next metering is obtained.

With this method of operation, it can be guaranteed that a very precise angle variable FBWS for the actual feed start is available at a very early time.

Subsequently, an angle variable for the feed duration FDS is read from performance characteristics 560. The angle variable at which the feed of fuel must be ended is obtained from the total of the actual feed start FBWS and the performance characteristics FDS. In order to obtain the angle variable at which the solenoid valve must be started, the output signal of the switching time calculation 570 must also be taken into consideration. The switching time calculation 570 takes place using the rotational speed and the switching time values N, TEN, which are used as a basis of the pick-up of performance characteristics. Based upon these two variables, the angle variable FEWS which represents the reference value for feed end is then obtained.

The feed end regulator 505 then regulates the actual feed end to this reference value FEWS for the feed end. In the addition point 575, the reference value is corrected by the correction value FEWK for the feed end. Subsequently, block 590 calculates the exact starting time for the solenoid valve by means of an extrapolation.

After activation of the solenoid valve, the second interpolation 585 calculates an angle variable FEWS2 which indicates the feed end. This angle variable FEWS2, determined by interpolation, is compared with the reference value FEWS in the addition point 580. The difference FEWD of these two values is multiplied by the factor K2 in block 605. This value forms the correction angle FEWK for the next metering. The correction angle of the previous metering is added to this value in the addition point 600.

The reference angle FEWS is then corrected by this correction angle FEWK in the addition point 575. So long as there is a deviation between the desired feed end angle FEWS and the feed end angle FEWS2 determined by interpolation, the correction angle FEWK is continuously corrected. If these two values match, no change in the correction angle takes place, and starting takes place at the optimum time.

The angle variable is determined by extrapolation before the event. After the event, the angle variable is determined by interpolation. The angles obtained by extrapolation are changed, by a simple regulation algorithm, until the angle variable determined by interpolation matches the angle variable determined by extrapolation. In this way, the errors which systematically occur in extrapolation, especially changes in rotational speed, can be eliminated.

With the method according to the present invention, both the feed start and the feed end can be separately regulated to a predetermined reference value. Furthermore, the angle variable which indicates the feed start can be very precisely determined by a corresponding observer.

What is claimed is:

1. A method of controlling a solenoid-valve-controlled fuel-metering system for an internal combustion engine, comprising the steps of:

determining at least one of a starting time and a stopping time for actuating the solenoid valve based upon at least one of a feed start variable and a feed duration variable;

determining an angle variable based upon a time variable indicative of an actual flow of fuel to the engine, and based upon at least one of an instantaneous rotational speed of the engine and a correction angle;

extrapolating a first angle variable based upon a first instantaneous rotational speed of the engine;

interpolating a second angle variable based upon a second instantaneous rotational speed of the engine, and controlling the solenoid-valve-controlled fuel-metering system as a function of the first and second angle variables.

2. A method of controlling a solenoid-valve-controlled fuel-metering system for an internal combustion engine, comprising the steps of:

determining at least one of a starting time and a stopping time for activating the solenoid valve based upon at least one of a feed start variable and a feed duration variable;

determining an angle variable indicative of one of an actual start of flow of fuel to the engine and an actual end of flow of fuel to the engine, said angle variable based upon a time variable indicative of an actual flow of fuel to the engine, and based upon at least one of an instantaneous rotational speed of the engine and a correctional angle;

extrapolating a first angle variable based upon a first instantaneous rotational speed of the engine;

interpolating a second angle variable based upon a second instantaneous rotational speed of the engine, and controlling the solenoid-valve-controlled fuel-metering system as a function of the first and second angle variables.

3. The method as recited in claim 1 or 2, further comprising the steps of:

detecting the first instantaneous rotational speed of the engine in a first time increment; and detecting the second instantaneous rotational speed of the engine in a second time increment.

4. The method as recited in claim 3, wherein the second time increment immediately follows the first time increment.

5. The method as recited in claim 3, wherein the time variable lies within the second time increment.

6. The method as recited in claim 1 or 2, further comprising the step of adding the first angle variable with the correction angle to determine the angle variable.

7. The method as recited in claim 1 or 2, further comprising the step of determining a difference angle based upon the first and second angle variables.

8. The method as recited in claim 7, further comprising the step of adding the correction angle and the difference angle to form a subsequent correction angle.

9. The method as recited in claim 1 or 2, wherein the angle variable is indicative of one of an actual start of flow of fuel to the engine and an actual end of flow of fuel to the engine.

10. A method of controlling a solenoid-valve-controlled fuel-metering system for an internal combustion engine, comprising the steps of:

determining at least one of a starting time and a stopping time for actuating the solenoid valve based upon at least one of a feed start variable and a feed duration variable;

determining an angle variable based upon a time variable indicative of an actual flow of fuel to the engine, and based upon at least one of an instantaneous rotational speed of the engine and a correction angle;

determining an extrapolation angle;

determining an interpolation angle;

determining a first difference angle between the extrapolation angle and the interpolation angle; and determining the correction angle based upon the first difference angle.

11. A method of controlling a solenoid-valve-controlled fuel-metering system for an internal combustion engine, comprising the steps of:

determining at least one of a starting time and a stopping time for activating the solenoid valve based upon at least one of a feed start variable and a feed duration variable;

determining an extrapolation angle;

determining an interpolation angle;

determining a first difference angle between the extrapolation angle and the interpolation angle;

determining a correction angle based upon the first difference angle; and determining an angle variable indicative of one of an actual start of flow of fuel to the engine and an actual end of flow of fuel to the engine, said angle variable based upon a time variable indicative of an actual flow of fuel to the engine, and based upon at least one of an instantaneous rotational speed of the engine and the correction angle.

12. The method as recited in claim 10 or 11, further comprising the step of determining an injection start angle variable based upon the correction angle.

13. The method as recited in claim 10 or 11, further comprising the step of multiplying the first difference angle by a preselected first factor.

14. The method as recited in claim 10 or 11, further comprising the steps of:

determining a second difference angle between an injection end angle variable and the interpolation angle;

multiplying the second difference angle by a preselected second factor; and determining the correction angle based upon the multiplied second difference angle.

15. A method of controlling a solenoid-valve-controlled fuel-metering system for an internal combustion engine, comprising the steps of:

determining a rotational speed of the engine;

determining a time value indicative of one of a start of flow of fuel to the engine and an end of flow of fuel to the engine;

converting the time value into an angle value as a function of the rotational speed of the engine; and controlling the solenoid-valve-controlled fuel-metering system as a function of the angle value.

16. An apparatus for controlling a solenoid-valve-controlled fuel-metering system for an internal combustion engine, comprising:

means for determining a rotational speed of the engine; and an electronic device for determining a time value indicative of one of a start of flow of fuel to the engine and an end of flow of fuel to the engine, for converting the time value into an angle value as a function of the rotational speed of the engine, and for controlling the solenoid-valve-controlled fuel-metering system ass a function of the angle value.

17. A method of controlling a solenoid-valve-controlled fuel-metering system for an internal combustion engine, comprising the steps of:

measuring a first rotational speed of the engine;

measuring a second rotational speed of the engine;

determining a time value indicative of an actual flow of fuel to the engine;

determining a first angle value based upon the time value and the first rotational speed;

determining a second angle value based upon the time value and the second rotational speed; and controlling the solenoid-valve-controlled fuel-metering system as a function of the first and second angle values.

18. The method as recited in claim 17, wherein the time value is indicative of one of an actual start of flow of fuel to the engine and an actual end of flow of fuel to the engine.

19. An apparatus for controlling a solenoid-valve-controlled fuel-metering system for an internal combustion engine, comprising means for measuring a first and second rotational speed of the engine; and a control unit for determining a time value indicative of an actual flow of fuel to the engine, for determining a first angle value based upon the time value and the first rotational speed, for determining a second angle value based upon the time value and the second rotational speed, and for controlling the solenoid-valve-controlled fuel-metering system as a function of the first and second angle values.

20. The apparatus as recited in claim 19, wherein the time value is indicative of one of an actual start of flow of fuel to the engine and an actual end of flow of fuel to the engine.

21. The apparatus as recited in claim 19, wherein the control unit further determines an angle value corresponding to the time value based upon the first and second angle values.

22. The apparatus as recited in claim 21, wherein the angle value is indicative of a position of an increment wheel coupled to a drive shaft, the drive shaft, in turn, being coupled to the engine.

* * * * *